US005117534A

United States Patent [19]

Temburg

[11] Patent Number: 5,117,534

[45] Date of Patent: Jun. 2, 1992

[54] METHOD FOR DETACHING TUFTS FROM FIBER BALES

[75] Inventor: Josef Temburg, Jüchen, Fed. Rep. of Germany

[73] Assignee: Trützschler GmbH & Co. KG, Monchen-Gladbach, Fed. Rep. of Germany

[21] Appl. No.: 629,695

[22] Filed: Dec. 18, 1990

[30] Foreign Application Priority Data

Dec. 19, 1989 [DE] Fed. Rep. of Germany ..... 3941855

[51] Int. Cl.[5] ..... D01G 7/00

[52] U.S. Cl. ..... 19/80 R

[58] Field of Search ..... 19/80 R, 80 A, 81, 97.5

[56] References Cited

U.S. PATENT DOCUMENTS

| | | | |
|---|---|---|---|
| 4,477,944 | 10/1984 | Binder et al. | 19/80 R |
| 4,707,888 | 11/1987 | Binder et al. | 19/80 R |
| 4,780,933 | 11/1988 | Pinto et al. | 19/80 R |
| 4,827,572 | 5/1989 | Walk | 19/80 R |
| 4,928,354 | 5/1990 | Hanselmann et al. | 19/80 R |

FOREIGN PATENT DOCUMENTS

| | | | |
|---|---|---|---|
| 266629 | 10/1987 | European Pat. Off. | 19/80 R |
| 326913 | 8/1989 | European Pat. Off. . | |
| 8625108 | 3/1988 | Fed. Rep. of Germany . | |
| 3706268 | 8/1988 | Fed. Rep. of Germany . | |
| 3913929 | 2/1990 | Fed. Rep. of Germany . | |

*Primary Examiner*—Werner H. Schroeder
*Assistant Examiner*—Michael A. Neas
*Attorney, Agent, or Firm*—Spencer, Frank & Schneider

[57] ABSTRACT

A method of removing fiber tufts from a top surface of a fiber bale with a travelling opening device includes the steps of moving the opening device along the top surface of the fiber bale toward and away from a stationary wall face against which a vertical end face of the fiber bale abuts; and codirectionally rotating pressing rolls which are mounted in the opening device travels away from the wall face, the pressing roll which is farthest away from the wall face is lifted from the top bale surface while a bale-penetrating position of the pressing roll which is closest to the wall face is maintained.

1 Claim, 2 Drawing Sheets

METHOD FOR DETACHING TUFTS FROM FIBER BALES

CROSS REFERENCE TO RELATED APPLICATION

This application claims the priority of Federal Republic of Germany application No. P 39 41 855.3 filed Dec. 19th, 1989, which is incorporated herein by reference.

BACKGROUND OF THE INVENTION

This invention relates to a method for removing tufts from fiber bales, particularly highly compressed cotton bales, synthetic fiber bales or the like. The apparatus for performing the method includes a detaching (opening) device which travels back and forth above the fiber bales and includes, for example, at least one rapidly rotating opening roll flanked by axially parallel, circumferentially toothed pressing rolls which may be driven and which penetrate into the bale face. The fiber tufts removed by the opening device are carried away mechanically or in an air stream.

In order to aid the fiber tuft removal from the top layer of a fiber bale which abuts a rigid vertical wall, it is known to provide each pressing roll with a rotation blocking device which may be operated independently from one another. Each pressing roll has its own separate drive motor. The pressing roll which is remote from the vertical wall is either reversed or is stopped by means of the rotation blocking device. Such a system is disadvantageously complex and further, an undesirable delay occurs during the reversal steps.

SUMMARY OF THE INVENTION

It is an object of the invention to provide an improved method of the above-outlined type which eliminates the discussed disadvantages and which thus in particular improves in a simple manner the removal of fiber tufts from the top layer of a fiber bale which abuts a vertical wall.

This object and others to become apparent as the specification progresses, are accomplished by the invention, according to which, briefly stated, the pressing rolls are both rotated in the same direction and may be individually lifted off the bale surface.

By virtue of the fact that the toothed pressing roll which is remote from the vertical wall is lifted off the fiber bale face, it is possible to maintain the rotation of the commonly driven pressing rolls in the same direction without interruption. Thus, separate drives and rotation blocking devices needed in the prior art constructions may be dispensed with. The lifted pressing roll continues to rotate in the space above the bale top while the pressing roll which is adjacent the vertical wall feeds the fiber material of the top layer in the direction of the opening roll (detaching roll).

According to a further feature of the invention, a separate lifting device is associated with each toothed pressing roll. According to a further feature of the invention, the lifting device includes a pneumatic cylinder. According to another feature of the invention, the lifting device includes a threaded spindle. In accordance with still another advantageous feature of the invention, the opening device is tiltable about the axis of the opening roll such that one of the toothed pressing rolls is brought out of engagement with the top bale face.

DESCRIPTION OF THE PREFERRED EMBODIMENTS

Figure 1:
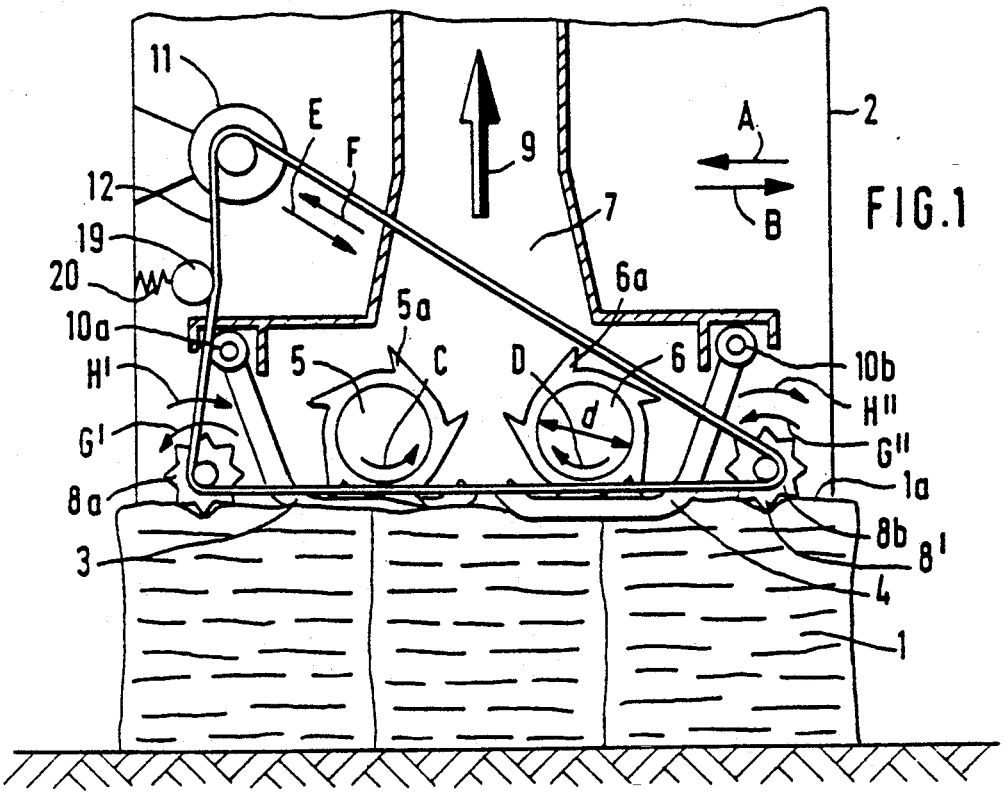
FIG. 1 is a schematic side elevational view of a preferred embodiment of the invention.

Turning to FIG. 1, there is shown therein a preferred embodiment of the invention incorporated in a bale opener which may be a BLENDOMAT BDT model, manufactured by Trützschler GmbH & Co. KG, Mönchengladbach, Federal Republic of Germany. A series of fiber bales 1 is set up in a free-standing manner on a floor along rails, on which a carriage of the bale opener may be moved back and forth. On the carriage there is mounted a tower which, in turn, carries the opening device proper which may be vertically movable relative to the tower. The rails, the carriage and the tower are not illustrated in FIG. 1.

The opening device includes a housing 2, two grates 3 and 4, two opening rolls 5 and 6 associated with a separate one of the grates 3 and 4 as well as a suction hood 7 arranged above the opening rolls 5, 6. In the working zone adjacent the bale face the opening rolls 5 and 6 are rotated toward one another as shown by the arrows C and D. The opening device travels in the direction of arrows A and B. The grates 3 and 4 which are spring-biased and rotatably supported in bearings 10*a*, 10*b*, are arranged between rows of teeth 5*a*, 6*a* underneath the respective opening roll 5 and 6. The grates 3 and 4 engage the top face 1*a* of the fiber bales and thus function as hold-down devices. The two opening rolls 5 and 6 are flanked by axially parallel pressing rolls 8*a* and 8*b* which press down on the upper face 1*a* of the fiber bales 1. By virtue of such a pressing force and further, by virtue of the penetration of the teeth 8' of the pressing rolls 8*a* and 8*b* into the top bale surfaces, the fiber bales 1 are immobilized and are prevented from tipping over.

In operation, the bale opener, together with the opening rolls 5 and 6, travels back and forth along the fiber bale series 1, while the opening rolls 5 and 6, projecting through the grates 3 and 4, remove fiber tufts from the top face 1*a* of the fiber bales 1. The fiber tufts detached by the opening rolls 5 and 6 are thrown directly into an air stream 9 which flows through the suction hood 7.

The pressing rolls 8*a* and 8*b* are commonly driven by a motor 11 with the intermediary of a flexible drive element, such as a chain 12 which may selectively run in the direction E or F, whereby the pressing rolls 8*a*, 8*b* rotate in directions G', H' or, respectively, G'', H''. The chain 12 is tensioned by a roller 19 biased by a spring 20 which, in turn, is supported in the housing 2.

Figure 2A:
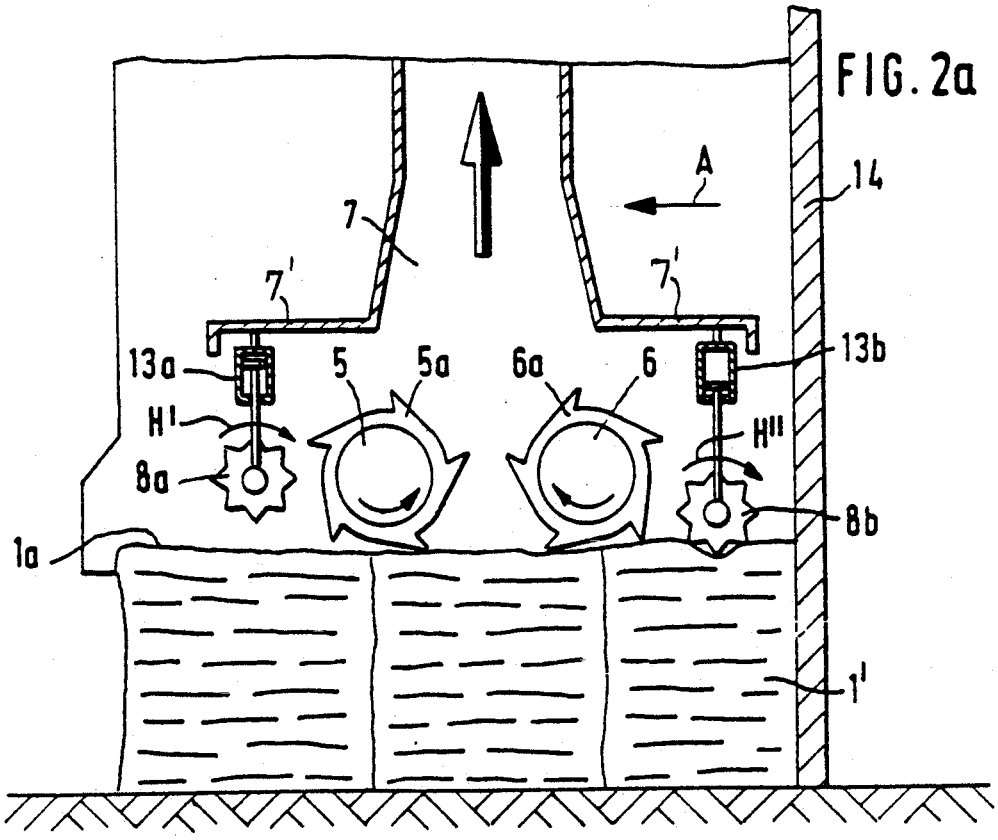
FIGS. 2*a* and 2*b* are schematic side elevational views of a further preferred embodiment of the invention, illustrating two different operational positions.
Figure 2B:
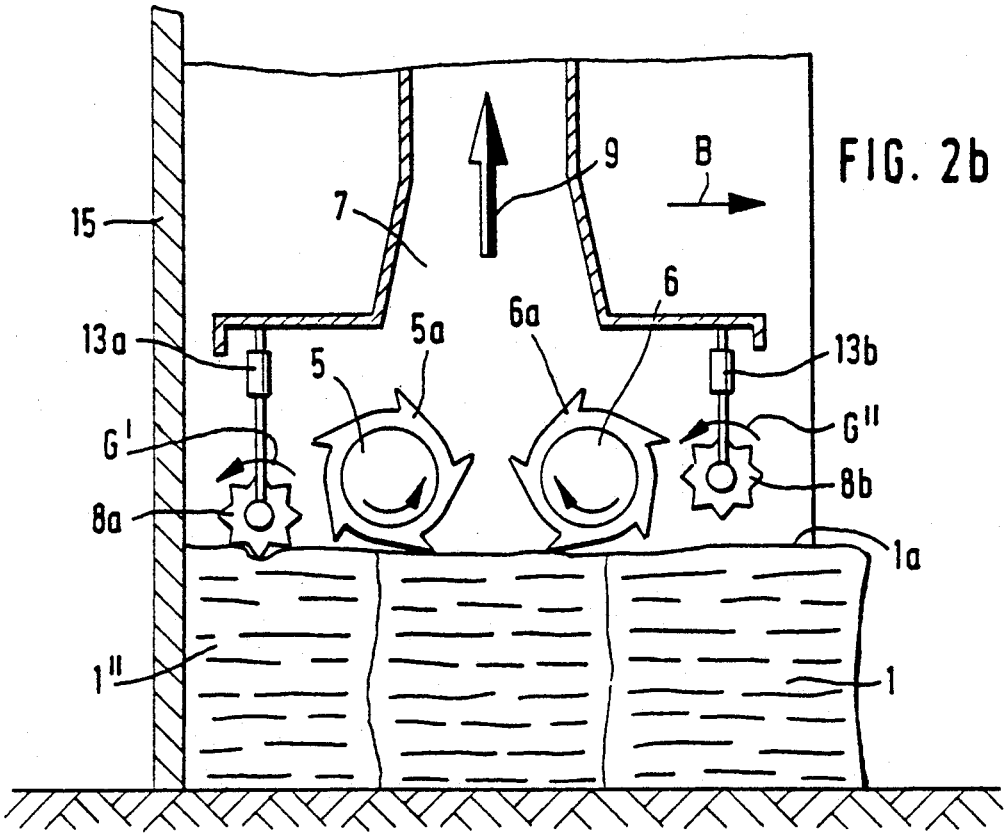

Turning to FIGS. 2*a* and 2*b*, the toothed pressing rolls 8*a*, 8*b* are associated with respective pneumatic lifting cylinders 13*a*, 13*b* which are mounted on a cover 7'. As shown in FIG. 2*a*, the right-hand terminal fiber bale 1' is, with its vertical end face, in a face-to-face engagement with a substantially vertical wall 14. The pressure cylinder 3*a* which is remote from the wall 14, lifts the pressing roll 8*a* off the upper face 1*a* of the fiber bales. Thus, as the bale opener moves in the direction A, away from the wall 14, the pressing roll 8*a* is out of contact with the top face 1*a* of the fiber bales and continues its rotation in the direction of the arrow H'. The pressing roll 8*b* remains in engagement with the bale surface 1*a* and continues to rotate in the direction H" and shifts the top fiber layer of the fiber bale in the direction of the opening rolls 5, 6. In FIG. 2*b* it is the left-most terminal fiber bale 1" which, with its vertical end face, is in a face-to-face engagement with a substantially vertical wall 15. In this arrangement the pressure cylinder 13*b* which is remote from the wall 15 lifts the pressing roll 8*b* off the upper face 1*a* of the fiber bales and continues to run in a lifted state in the rotary direction G". At the same time, the pressing roll 8*a* remains in engagement with the top bale face 1*a* and continues to rotate in the direction G' and aids the supply of fiber material to the opening rolls 5, 6 by shifting the top fiber layer of the fiber bales in the direction of the opening rolls 5, 6.

Figure 3:
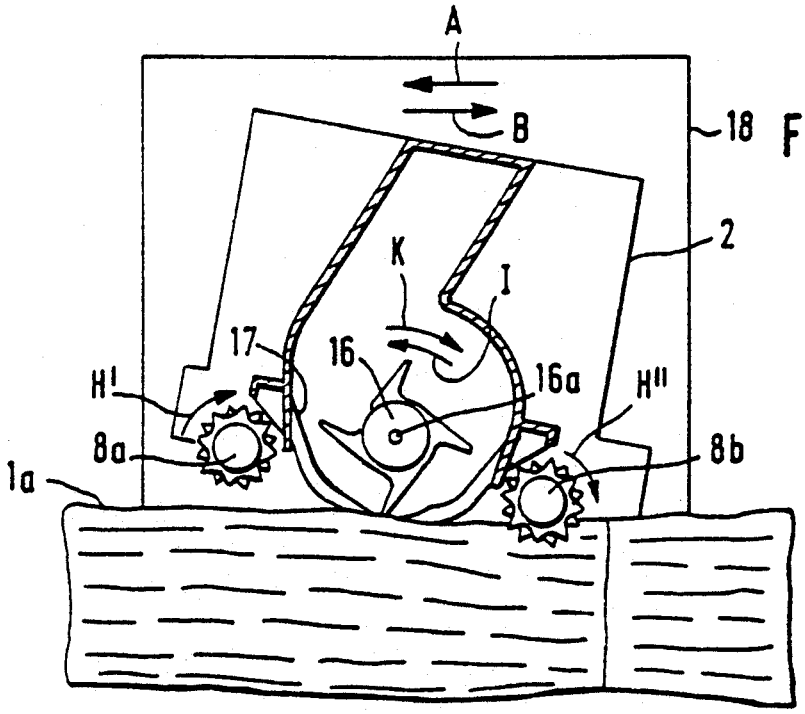
FIG. 3 is a schematic side elevational view of yet another preferred embodiment of the invention.

In FIG. 3, the housing 2 is rotatable about a horizontal axis which coincides with the axis 16*a* of the single opening roller 16 which cooperates with a grate 17. FIG. 3 illustrates schematically the bale opener tower 18 which supports the housing 2. By virtue of rotation of the housing 2 in the direction of the arrow K, the pressing roll 8*a* is moved out of engagement with the top bale face 1*a*, whereas the pressing roll 8*b* remains in engagement with the top bale face 1*a* and delivers fibers in the direction of the opening roll 16. Upon rotation of the housing 2 in the direction of the arrow I, the pressing roll 8*b* is lifted off the top bale face 1*a* while the other pressing roll 8*a* remains in engagement with the top bale face.

It will be understood that the above description of the present invention is susceptible to various modifications, changes and adaptations, and the same are intended to be comprehended within the meaning and range of equivalents of the appended claims.

What is claimed is:

1. A method of removing fiber tufts from a top surface of a fiber bale with an apparatus including a bale opening device having a fiber tuft removing tool and toothed pressing rolls flanking the tool; the method including the step of moving the opening device along the top surface of the fiber bale toward and away from a stationary wall face against which a vertical end face of the fiber bale abuts; the improvement comprising the steps of (a) codirectionally driving said pressing rolls;

(b) during travel of the opening device away from the wall face, lifting from the top bale surface the pressing role which is farthest away from the wall face and (c) simultaneously with step (b), maintaining in a bale-penetrating position the pressing roll which is closest to the wall face.

* * * * *